United States Patent [19]

Antonissen

[11] Patent Number: 4,531,436

[45] Date of Patent: Jul. 30, 1985

[54] SLICING MACHINE HAVING INTERRUPT MEANS

[75] Inventor: Peter Antonissen, Norfolk, England

[73] Assignee: Thurne Engineering Company Limited, Norwich, England

[21] Appl. No.: 614,428

[22] Filed: May 29, 1984

[30] Foreign Application Priority Data

May 27, 1983 [GB] United Kingdom ..... 8314768

[51] Int. Cl.[3] ..... B26D 7/28

[52] U.S. Cl. ..... 83/68; 83/71; 83/82; 83/88; 83/69

[58] Field of Search ..... 83/57, 68, 73, 77, 71, 83/81, 82, 88, 278, 69

[56] References Cited

U.S. PATENT DOCUMENTS 3,107,709 10/1963 Garapolo et al. ..... 83/57

*Primary Examiner*—James M. Meister

*Attorney, Agent, or Firm*—Sughrue, Mion, Zinn, Macpeak & Seas

[57] ABSTRACT

A slicing machine for slicing food products, particularly meat and other meat products 7 comprises a rotating blade 1 which either has a spiral cutting edge or a circular cutting edge and is mounted for planetary motion, and a pushing mechanism 8, 9, 11, 12 to feed the product towards the blade 1 so that upon each rotation or gyration of the blade a slice is cut from the face of the product 7. The slicing machine also includes a cam and proximity switch 34, 35 for monitoring the position of the blade 1 and outputting a signal when the blade is in a predetermined position, an event counter 19 for establishing when the blade 1 is cutting the slice to form the last slice in a group of slices and outputting a signal indicating this condition, a manually operated interrupt switch 27, and a computer 18 to interrupt the feed of the product to be sliced towards the blade 1 of the slicer. The computer 18 is enabled by the operation of the cam and proximity switch 34, 35 and event counter 19 and the interrupt switch 27 simultaneously so that, after manual actuation of the interrupt switch 27, feed of material is disabled only at a time when a complete shingled group of slices has been formed.

9 Claims, 6 Drawing Figures

SLICING MACHINE HAVING INTERRUPT MEANS

BACKGROUND OF THE INVENTION

This invention relates to slicing machines for slicing food products, particularly slicing cheese, meat and pressed or moulded meat products.

A slicing machine for such products comprises a rotating blade which either has a spiral cutting edge or has a circular cutting edge and is mounted for planetary motion, and means to feed the product towards the blade so that upon each revolution or each gyration of the blade one clise is cut from the face of the product. The means to feed the product may be a continuous conveyor but usually the slicer includes a fixed platform on which the product is placed and a feeding head which engages the rear face of the product and which urges the product towards the blade. The feeding head is moved by a hydraulic ram or by a leadscrew driven by a stepping or variable speed electric motor.

The product may be moved forward at a constant speed and since the rotation or gyration of the blade is also constant, each successive slice is of substantially uniform thickness but each slice is inclined to the direction of movement of the product. This has a disadvantage that wedge-shaped slices of meat are cut from the first and last slices and whenever the cutting is interrupted. Such wedge-shaped slices are significantly underweight. Because of this it is desirable to move the product stepwise each time the cutting edge of the blade is out of contact with the product. This technique is more commonly used where the slices fo product are required to be thicker and where the product is comparatively firm. As the rear face of the product is moved forward in a stepwise fashion it is moved forwards rather suddenly and this results in a shock wave being transmitted from the rear face of the product along its length. This shock wave or vibration passing down the length of product can cause the front face to move in an irregular fashion whilst the next slice is being cut from it. This leads to the slices having an irregular thickness and a very irregular weight. This is particularly true of meat and meat products that are relatively soft and obviously particularly noticeable where very th in slices of product are cut. An example of this is where the product is ham or sausage. It is also possible for the product to be urged forwards stepwise so rapidly that once the block of meat or meat product starts to move it continues to move and pulls away from the feeding head, so causing further damage to it.

A slicing machine is usually required to produce groups of slices and this may be achieved by having the slicing machine discharge onto a constant speed conveyor and then interrupting the feed of the product towards the blade for a period of time, each time a predetermined number of slices have been cut from its face, but, more usually, the conveyor downstream from the slicing machine is a jump conveyor. In this case, the conveyor moves forward at a first speed whilst slices are cut from the product at a uniform rate and then, after the number of slices required for each group have been cut, the jump conveyor moves at a second speed, considerably faster than the first speed, and then returns to the first speed. In this way, the slices are cut at a uniform rate but the increase in speed of the jump conveyor after each group of slices has been cut results in a series of groups of slices being formed on the jump conveyor.

Such slicing machines are usually provided at the upstream ends of a packaging line and whilst the packaging line is usually arranged to run on a continuous basis, it is sometimes necessary to interrupt the slicing operation if, for example, the packaging line is undermanned or there is some interruption in a downstream packaging machine. Under such circumstances it is necessary to stop the operation of the slicing machine halfway through a piece of product. Normally, this is achieved by stopping the feed of the product towards the blade but this invariably occurs in the middle of a sliced group so that group is not complete. Also, upon restarting the slicing machine the first group produced by the slicing machine is also often incomplete. When the feed of product towards the blade is operated continuously, stopping the feeding head during its travel results in both the last slice that is cut before the interruption and the first slice that is cut after the interruption being wedge-shaped and the weight of the group containing those slices being less than the standard pack weight.

SUMMARY OF INVENTION

According to this invention a slicing machine includes first means for monitoring the position of the blade and outputting a signal when the blade is in a predetermined position, second means for establishing when the blade is cutting the slice to form the last slice in a group of slices and outputting a signal indicating this condition, a manually operated interrupt switch, and interrupt means to interrupt the feed of the product to be sliced towards the blade of the slicer, the interrupt means being enabled by the operation of the first and second means and the interrupt switch simultaneously, so that, after manual actuation of the interrupt switch, the feed of the product is disabled only at a time when a complete group of slices has been formed.

When the product to be sliced is moved stepwise it is moved only when the edge of the blade is out of contact with the product. In this case, the feed of the product to be sliced towards the blade of the slicer is disabled after the cutting of the last slice of the group so that the product is not moved towards the blade after the completion of this slice. When the product is moved continuously it is preferred that the feed of the product towards the blade is interrupted substantially half way through cutting the last slice of a group. Equally, in this case, when the feed of the product is recommenced after the interruption it is preferred that the feed of the product is recommenced substantially halfway through the movement of the edge of the blade to cut a slice. When the feed of the product is stopped and recommenced in this fashion, the last slice that is cut is virtually a full slice, typically it is at least 95% of the weight of a full slice and the following rotation or gyration of the blade simply cuts a very thin wedge-shaped portion off half the face of the piece of meat or meat product which typically accounts for only 5% of the weight of a full slice. Naturally this piece is wasted. Equally, upon the reactuation of the feed of the piece of meat or meat product towards the blade the first slice that is cut, is only a part slice and a small wedge-shaped slice amounting to about 5% of the weight of a typical slice. This is also wasted but the next slice is a substantially full slice having typically 95% of the weight of a full slice. When the feed is interrupted at this time, a typical group of slices containing say five slices is thus well within the tolerance limits since only one slice of that group is affected by the interruption, typically, a group of slices containing five slices is within 1% of the required weight.

Preferably the slicing machine includes a jump conveyor downstream from the blade to marshall the slices cut by the blade into groups. In this case the second means for establishing when the blade is cuting the slice to form the last slice in a group of slices and outputting a signal indicating this condition may be formed by the same element that initiates the operation of the jump conveyor to produce the groups of slices. Alternatively, the second means may be formed by a subsidiary counter reset to the required number of slices in each group and arranged to respond to the output signal from the means. The interrupt means may include an AND gate arranged to gate together the outputs from the first means, the second means and the interrupt switch.

It is preferred however that the slicing machine includes a computer which is programmed to control the operation of the slicing machine and the jump conveyor and programmed only to interrupt the slicing operation after completion of one complete group of slices. When the slicing machine includes a computer arranged to control the feeding means and arranged to move the feeding head stepwise it is preferred that the computer controls the rate of movement of the feeding head in such a way that the feeding head moves throughout substantially the entire time that the cutting edge of the blade is out of contact with the meat or meat product. By spreading the movement of the feeding head over substantially the entire time that the cutting edge of the blade is out of contact with the product the movement of the feeding head is made as slow and as gentle as possible, consistent with the block of product being moved to the required extent whilst the cutting edge is out of contact with it. This reduces, as far as possible, the generation of shock waves and vibrations throughout the product.

Naturally the slicing machine still includes an emergency stop control to stop the operation of the slicing machine in the shortest possible time to provide a safety stop for the slicing machine.

When the slicing machine is operating to move the feeding head in a stepwise fashion the block of product is always stationary throughout the entire period during which the cutting edge of the blade is moving across its face to cut a slice from it. Thus, in this case, the cuts are always exactly normal to the direction of motion of the piece of meat or meat product.

Accordingly, when the operation of the slicing machine is interrupted by actuation of the manually operated interrupt switch the slicing operation is continued until the last slice for a particular group has been cut and after this, the subsequent feeding operation of the feeding head is prevented. Thus, whilst the blade continues to rotate no further slices are cut from the face of the block of product. However, when it is required to restart the slicing operation, the feed of the piece of meat or meat product is recommenced immediately after the blade has moved away from the block of product so that upon the next rotation or gyration of the blade a normal slice is cut from its face and this slice then forms the first slice of the next group to be produced.

BRIEF DESCRIPTION OF DRAWINGS

The operation of an example of slicing machine in accordance with this invention will now be described and contrasted with the operation of existing slicing machines, with reference to the accompanying drawings; in which.

DESCRIPTION OF PREFERRED EXAMPLE

Figure 1:
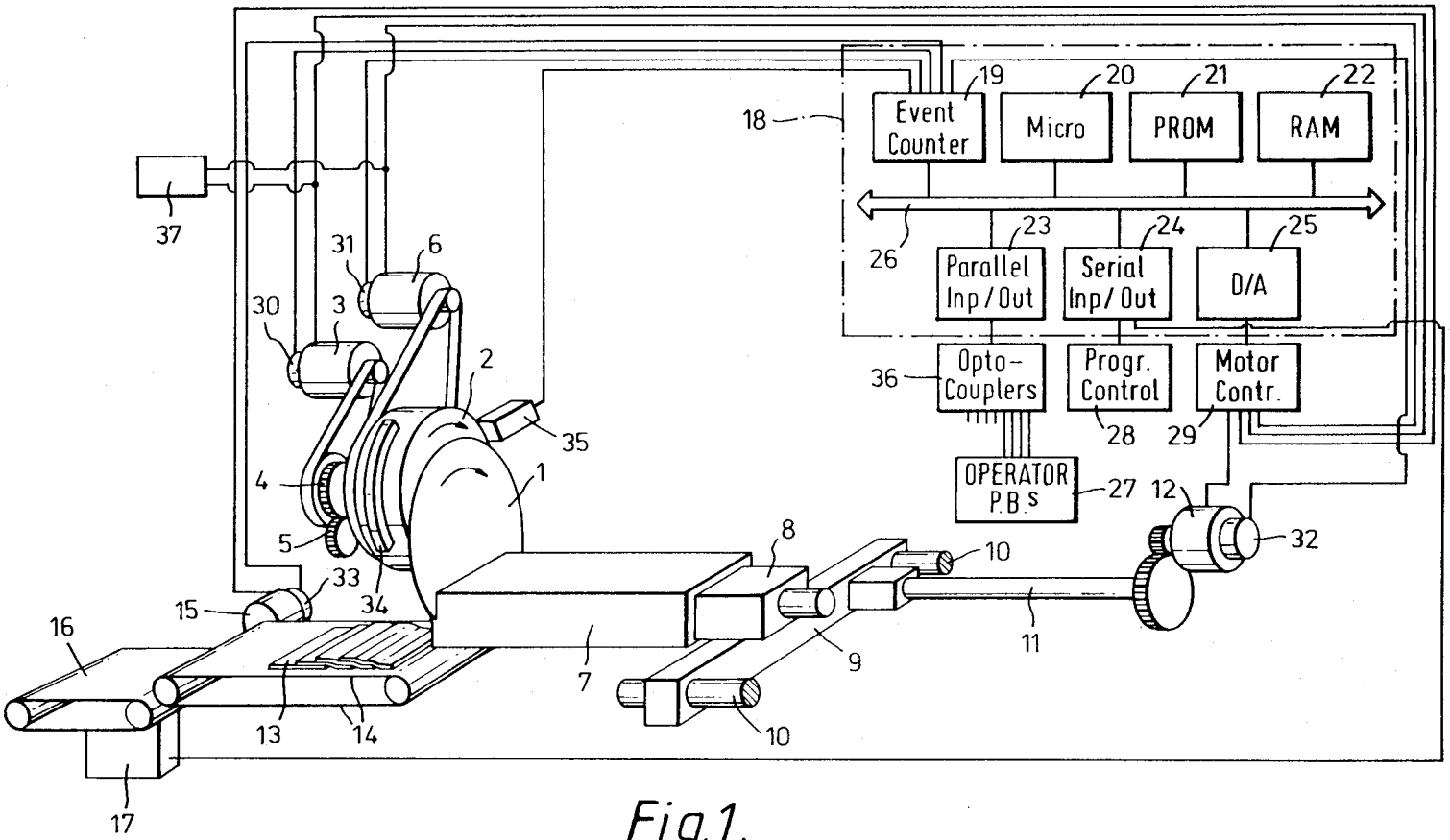
FIG. 1 is a diagrammatic representation of the slicing machine and jump conveyor; and, FIGS. 2 to 6 are all diagrams of slices cut from a block of meat with the thickness of the slices shown greatly exaggerated.

The basic mechanical construction of the slicing machine and jump conveyor is conventional and is typically like that known as a "Polyslicer" manufactured by Thurne Engineering Co. Ltd of Norwich, United Kingdom. It comprises a planetary blade 1, journalled in a counter-rotating hub 2. The blade 1 is driven by a motor 3 through pinion gears 4 and 5 and the hub 2 is driven by a motor 6. A block 7 of meat or a meat product is placed on a feed table (not shown) and driven towards the blade 1 by feeding head 8. The feeding head 8 is mounted on a bearer 9 which is carried on a pair of rails 10. The feeding head 8 and bearer 9 are moved backwards and forwards along the rails is by a lead screw 11 which is rotated by a motor 12. Slices 13 of meat or meat product cut from the block 7 falls onto a jump conveyor 14 located downstream of the blade and driven by a motor 15. Downstream from the jump conveyor 14 is a conveyor 16 passing over a weigh cell 17. Slices 13 are cut from the face of the block 7 of meat by the blade 1 at a uniform rate. The jump conveyor 14 is moved forward continuously by the motor 15 at a first rate to provide a shingled group of slices as shown in FIG. 1 and then after completion of the number of slices to form that group the jump conveyor 14 is moved at a second, much faster rate by the motor 15, to provide a space between the last slice of one group and the first slice 13 of the next group. The groups of slices 13 are then fed from the jump conveyor 14 onto the conveyor 16 and as they pass over the weigh cell 17 their weight is monitored.

Whilst the mechanical arrangement of the slicer is generally conventional, the slicer also includes a computer 18. The computer 18 may be based on type RT1-1260/1262 manufactured by Prolog Corporation of the U.S.A., for example. The computer 18 typically includes an event counter 19, a microprocessor 20, a programmable read only memory 21, a random access memory 22, parallel input/output ports 23, serial input-/output ports 24, and digital to analogue convertor unit 25 all connected together by a bus 26. The computer 18 is also connected to operator control buttons 27, program control 28 and a motor controller 29. The motor controller 29 controls the operation of the motors 3, 6, 12 and 15 and these include encoders 30, 31, 32, and 33 respectively the outputs of which are fed into the computer.

A cam 34 is mounted on the hub 2 and this cooperates with a proximity switch 35 to identify the angular position of the hub 2. The proximity switch 35 is triggered off both the leading and trailing end of the cam 34 and the computer 18 can naturally also calculate any intermediate angular position by timing between successive actuations of the proximity switch 35. FIG. 1 shows the encoders 30, 31, 32 and 32, and the proximity switch 35 being directly linked to the event counter 19 for simplicity, in practice these are coupled through an optocoupling unit 36 and the ports 23. The computer 18 is thus arranged to control the operation of the motors 3, 6, 12 and 15, and hence control the peripheral speed of the blade 1, the rate of rotation of the hub 2 and hence the rate at which the slices 13 are cut from the block 7, the rate of movement of the block 7 towards the blade 1 and hence the thickness of each slice 13, and also to control the operation of the jump conveyor 14 and hence the number of slices in each group. It also controls the time of operation of the motor 12 in accordance with the output from the proximity switch 35.

Figure 2:
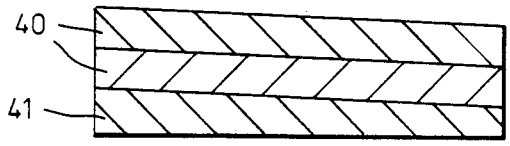

FIG. 2 shows the shape of slices 40 of meat or meat product that are cut when a piece of meat or meat product is fed continuously towards the continuously gyrating cutting blade 1. The slices 40 are inclined to the direction of movement of the meat since the block 7 of meat is moving whilst the cutting edge of the blade 1 moves across the face of the block of meat 7. If the feed of the block of meat or meat product towards the blade 1 is interrupted whilst the blade is out of contact with the piece of meat or meat product the next slice that is cut, slice 41, is generally wedge-shaped as shown in FIG. 2. This is caused by the upper face as shown in FIG. 2 having been cut whilst the block of meat was moving towards the blade whilst the lower face of the slice 42 is cut whilst the block of meat is stationary.

Figure 3:
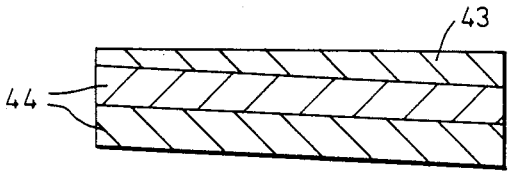

Upon restarting the movement of the block 7 towards the blade, assuming that it is also restarted whilst the blade 1 is out of contact with the block 7, the first slice, slice 43 shown in FIG. 3 is also wedge-shaped, again because its upper surface as shown in FIG. 3 is cut whilst the block 7 is stationary and because its lower surface is cut whilst the block of meat is moving and is therefore inclined to the direction of movement of the block of meat or meat product. Succeeding slices 44 are formed correctly. FIGS. 2 and 3 illustrate one conventional way of interrupting the operation of a conventional slicing machine and show how slices 41 and 43 are significantly underweight leading to the packs containing these slices also being significantly underweight.

Figure 4:
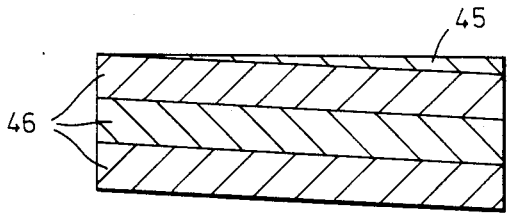

FIG. 4 illustrates what happens if the feed of the block 7 of meat or meat product towads the blade just as the cutting edge of the blade engages the product. In this case it is possible to get a very thin wedge-shaped slice of meat or meat product 45 as the first slice. Naturally such a slice is wasted because it is grossly underweight but this arrangement ensures that all of the remaining slices 46 are once again formed correctly. Typically the slice 45 represents wastage of about 15% of a normal slice.

Figure 5:
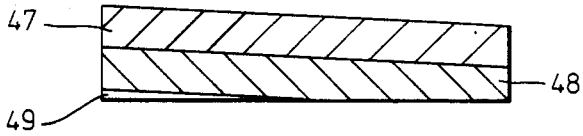
Figure 6:
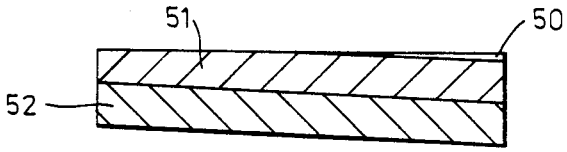

FIGS. 5 and 6 show the interrupt arrangement in accordance with this invention and with FIG. 5 slice 47 is formed correctly and then halfway through the next slice 48 which forms the last slice of a group of slices, the feed of the meat or meat product 7 towards the blade 1 is interrupted. This means that all of the upper face as shown in FIG. 5 of the slice 45 is inclined because all of this is cut whilst the block 7 of meat is moving towards the blade. The first half of the lower face of the slice 48 is also inclined because this is cut whilst the block 7 of meat is moving and the second half of this face of the slice 48 is normal to the direction of movement of the block 7 because the block is stationary during the cutting of the second half of the lower face of the slice 48. The following revolution or gyration of the cutting blade removes a very small wedge-shaped portion 49 which typically amounts to 5% of the weight of a complete slice. This portion 49 is wasted. Upon recommencement of the slicing of the block of meat after an interruption which is shown in FIG. 6, the feed of the block of meat towards the blade commences when the cutting edge of the blade 1 is halfway across the face of the block of meat 7. Thus the first cut that is made produces a very small slice 50 corresponding to the slice 49 and typically amounts to only 5% by weight of a complete slice. The next succeeding rotation or gyration of the blade cuts the slice 51 which corresponds to the slice 48, which forms the first slice of the next group of slices to be produced and which is typically 95% of the weight of a complete slice. The following slice 52 is completely uniform.

Assuming first of all that the slicing machine is arranged so that the motor 12 moves continuously to drive the block 7 product forward continuously whilst the blade 1 is rotating and orbiting slices 13 are cut regularly from the leading face of the block 7. The event counter 19 counts the orbits of the blade 1 by counting the output signals from the detector 35 and when this count has reached the required number of slices for each group the computer 18, via the motor controller 29, increases the speed of the motor 15 driving the jump conveyor 14 to initiate the jump sequence. Naturally the entire jump sequence takes place between the fall of the preceding slice onto the conveyor 14 and the fall of the next slice onto the conveyor 14.

When it is desired to interrupt the operation of the slicing machine the operator actuates one of the manually actuated operator push buttons 27 to send this interrupt instruction to the programmed computer 18. This instruction is held by the computer 18 and the computer 18 then waits for the event counter 19 to indicate that the cutting of a complete group of slices has just occurred. The computer 18 then via the motor control 29, stops the rotation of the motor 12 and so, interrupts the movement of the product 7 towards the blade 1 only at a time when, the blade is halfway through cutting the last slice of a group. Thus the last slice is virtually complete as described above.

The slicing machine may also be arranged to move the block 7 stepwise each time the blade 1 is away from the end face of the block 7. In this case the output of the detector 35 is used to indicate the position of the blade 1 around its orbit and so initiate the movement of the feed head 8 by the motor 12. The time available for moving the block 7 naturally varies with the orbiting speed of the blade 1 and the computer 18 is programmed to calculate the time that is available for moving the block 7 in accordance with the current orbiting speed of the blade 1 and control the speed of rotation of the motor 12 to ensure that the block 7 moves forward during substantially the entire time that the blade 1 is out of contact with the end face. This ensures that the stepwise movement of the block 7 is as smooth as possible because the extent of the movement of the block 7 is spread over the entire time that the blade 1 is out of contact with the end face of the block 7.

When the slicing machine is operating in the stepwise mode the computer 18 is programmed to allow the motor 12 to carry out the full movement of the block 7 to enable the final slice of that group to be cut. However, after completing of the cutting of this final slice in a group an interrupt signal having been received from the operator push button 27, the motor 12 is then not driven during the next period that the blade 1 is remote from the end face of the block 7.

The slcing machine also includes an emergency stop switch 37. This is coupled to both the motor 3 and the motor 6 and arranged so that upon actuation of the emergency stop switch 37 both motors are isolated from their power supply and also have electromagnetic braking circuits coupled to them so that both motors are brought to a standstill in the shorest possible time. Naturally the operation of the emergency stop switch 37 is independent of the control exercised by the computer 18 and thus, under these circumstances the slicing of a group is not completed before the motors 3 and 6 are stopped. The emergency stop switch 37 is again generally conventional and similar to those used previously.

I claim:

1. A slicing machine including a rotating blade, feed means to feed a product to be sliced towards said blade, monitoring means for monitoring said blade and outputting a signal when said blade is in a predetermined position, counting means for establishing when said blade is cutting the last slice in a group of slices and outputting a signal indicating this condition, a manually operated interrupt switch, and interrupt means to interrupt operation of said feed means, said interrupt means being enabled by operation of said monitoring means said counting means and said interrupt switch simultaneously, whereby after manual actuation of said interrupt switch said operation of said feed means is disabled only at a time so that a complete group of slices is formed.

2. The slicing machine of claim 1, wherein said feed means is arranged to move said product stepwise and only when the cutting edge of said blade is out of contact with said product, and wherein said feed means is disabled after cutting said last slice of said group, whereby said product is not moved towards said blade after completion of said last slice.

3. The slicing machine of claim 1, wherein said feed means moves said product continuously, and wherein said feed means is disabled substantially half way through cutting said last slice of said group whereby said product is not moved towards said blade after said blade has cut substantially halfway through said last slice.

4. The slicing machine of claim 3, wherein said feed means is enabled after an interruption substantially halfway through movement of said cutting edge of said blade to cut a slice.

5. The slicing machine of claim 1, which also includes a jump conveyor said jump conveyor being located downstream from said blade to receive slices cut by said blade, said jump conveyor marshalling said slices cut by said blade into groups.

6. The slicing machine of claim 5, wherein said counting means also initiates the jump operation of said jump conveyor to cause said jump conveyor to marshall said slices into said groups.

7. The slicing machine of claim 6, wherein said interrupt means and said cutting means are both formed by a programmed computer, said computer being programmed to interrupt operation of said feed means and said jump conveyor to provide only complete groups of slices.

8. The slicing machine of claim 7, wherein said feed means is arranged to move said product stepwise and only when the cutting edge of said blade is out of contact with said product, wherein said feed means is disabled after cutting said last slice of said group, whereby said product is not moved towards said blade after completion of said last slice, and wherein said computer controls said feed means in such a way that said feed means moves throughout substantially the entire time that said cutting edge of said blade is out of contact with said product thereby providing the gentlest feed.

9. The slicing machine of claim 1, which also includes an emergency stop control, said emergency stop control acting to rapidly stop operation of said slicing machine and provide a safety stop for said slicing machine.

* * * * *